United States Patent [19]

Nagayoshi

[11] 4,028,193

[45] June 7, 1977

[54] COKE OVEN DOOR

[75] Inventor: Konno Nagayoshi, Tokyo, Japan

[73] Assignee: Koritsu Kikaikogyo Co., Ltd., Japan

[22] Filed: Apr. 19, 1976

[21] Appl. No.: 677,965

[52] U.S. Cl. ..... 202/248; 110/173 R; 202/269

[51] Int. Cl.[2] ..... C10B 1/06; C10B 25/06

[58] Field of Search ..... 202/242, 247, 248, 250, 202/269; 110/173 R, 173 A, 173 B, 173 C

[56] References Cited

UNITED STATES PATENTS

| | | | |
|---|---|---|---|
| 1,745,390 | 2/1930 | Wilputte | 110/173 R |
| 2,007,318 | 7/1935 | Wilhelm | 202/248 |
| 2,478,215 | 8/1949 | Van Ackeren | 202/248 |
| 2,698,289 | 12/1954 | Wolff | 202/248 |
| 2,744,858 | 5/1956 | Homan | 202/248 |
| 2,803,592 | 8/1957 | Shimazaki | 202/248 |
| 3,032,483 | 5/1962 | Van Ackeren et al. | 202/248 |

*Primary Examiner*—Morris O. Wolk
*Assistant Examiner*—Roger F. Phillips
*Attorney, Agent, or Firm*—McGlew and Tuttle

[57] ABSTRACT

Construction of coke oven door which is characterized in that there is mounted an adiabatic layer on the inner surface of a base plate of a metallic door body in addition to conventional adiabatic door plug, the inner surface of the adiabatic layer being provided with a guard plate. A frame-like knife edge is installed on the periphery of the guard plate, the knife edge being formed at suitable intervals with U-shaped slots on the base plate side. The knife edge is further formed with pairs of projections on its outer surface on both sides of the U-shaped slots. A plurality of adjustable spring units are equipped on the side walls of the metallic door body and a hook lever, whose upper end ring portion is fitted on the upper end of the spring units and whose lower end hook engages with the projections, is arranged alongside the spring units.

3 Claims, 20 Drawing Figures

COKE OVEN DOOR

BACKGROUND OF THE INVENTION

This invention relates to an improved construction of coke oven door to be fitted to the openings at both sides of the battery, i.e. the pusher side and the coke side. Conventional constructions of coke oven doors are apt to gradually bend outwards due to temperature difference between the inner surface which is directly subjected to high coke oven temperatures and the outer surface which is exposed to the atmosphere or ambient air. When this results, oven gas leakage between the clearances formed at both the upper and lower portions of the door. A door knife edge or seal has heretofore been fitted to the peripheral portion of the door to prevent such leakage. However, since the knife edge bends together with the door, its tapping-out adjustment or reinstallation is required. With all such constructions, complete prevention of the gas leakage can not be achieved.

SUMMARY OF THE INVENTION

The object of this invention is to provide an improved construction of a coke oven door that is subjected to a minimum of bending without leakage or escaping of the oven heat. Another object of this invention is to provide an improved construction of a knife edge having fitting means and a depressing device that automatically enables the entire periphery of the knife edge or seal to closely contact the door sealing frame of the door opening and further enables the knife edge to continuously maintain such close contact to the door sealing frame even should the latter sealing frame be eventually bent.

This invention is particularly characterized in that there is mounted an adiabatic layer on the inner surface of the base plate of the metallic door body in order to prevent both the bending of the base plate and the escaping of the coke oven heat. The inner surface of the adiabatic layer is provided with a guard plate, and a frame-like knife edge is installed on the periphery of the guard plate. The knife edge is formed at suitable intervals with U-shaped slots on the base plate side to provide it with suitable flexibility. The knife edge is further formed with pairs of projections on the outer surface at both sides of the U-shaped slots. A plurality of equalizer or non-equalizer type adjustable spring units are equipped on the side walls of the metallic door body to closely contact the entire periphery of the knife edge automatically and equally to the door sealing frame of the coke oven door opening in cooperation with main springs built in the upper and lower latch bar units. A hook lever having an upper end ring portion fitted on the upper end of the spring unit, and having a lower end hook engaging with the projections arranged alongside the spring units, prevents the knife edge from protruding towards the door sealing frame by its margin spring pressure when the door is removed from the door opening.

In accordance with the present invention, since there is further employed an adiabatic layer on the inner surface of the base plate of the metallic door body in addition to a conventional adiabatic door plug, oven heat can be more effectively prevented than before from either escaping out the oven or being conducted to the base plate. As a result, there is not observed any appreciable temperature difference between the outer and inner surfaces of the base plate. Since the base plate can thus maintain an almost uniform temperature throughout its entire portions, there can not be observed any self-distortion, that is to say, outward bending caused by a difference of linear expansions between the inner and outer surfaces.

Further, since this invention adopts such construction that the knife edge is formed with plural U-shaped slots to provide flexibility, the knife edge is installed on the guard plate with separation to both the base plate and the side walls and the knife edge is depressed down by both the main springs of the latch bar units and the equalizer or non-equalizer type spring units, the entire periphery of the knife edge can closely contact the sealing frame to secure complete prevention of gas leakage even should the door sealing frame eventually bend.

Furthermore, employment of the hook lever enables secure prevention of the knife edge from protruding towards the door sealing frame when the door is removed from the door opening. This serves to eliminate eventual damage to either the door sealing frame or the knife edge.

BRIEF DESCRIPTION OF THE DRAWING

This invention will be illustrated in detail by way of examples in the accompanying drawings, in which:-

PREFERRED EMBODIMENT OF THE INVENTION

Figure 1:
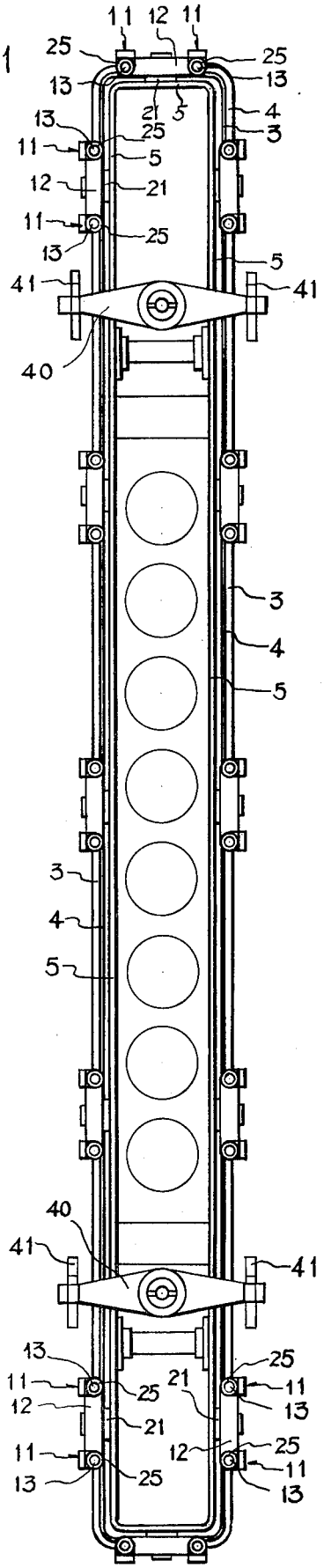
FIG. 1 is a front view of a door in accordance with one embodiment of the present invention.
Figure 2:
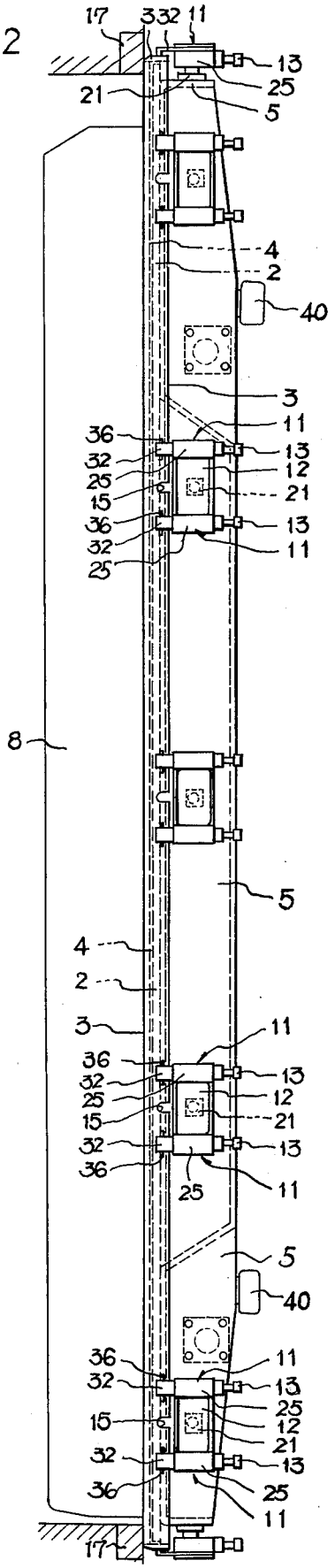
FIG. 2 is a side view of the same.
Figure 3:
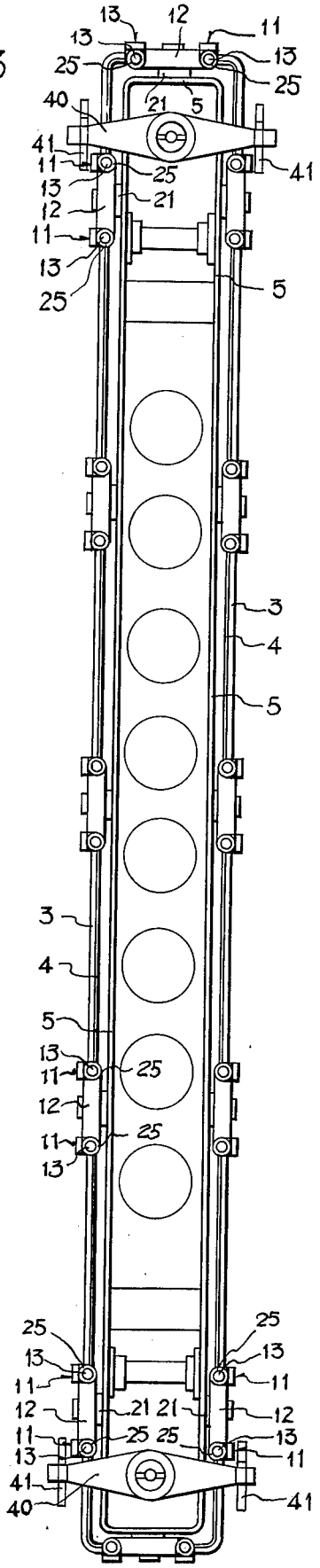
FIG. 3 is a front view of a door in another embodiment of the invention; each latch bar thereof being located at a position other than shown in FIGS. 1 and 2.
Figure 4:
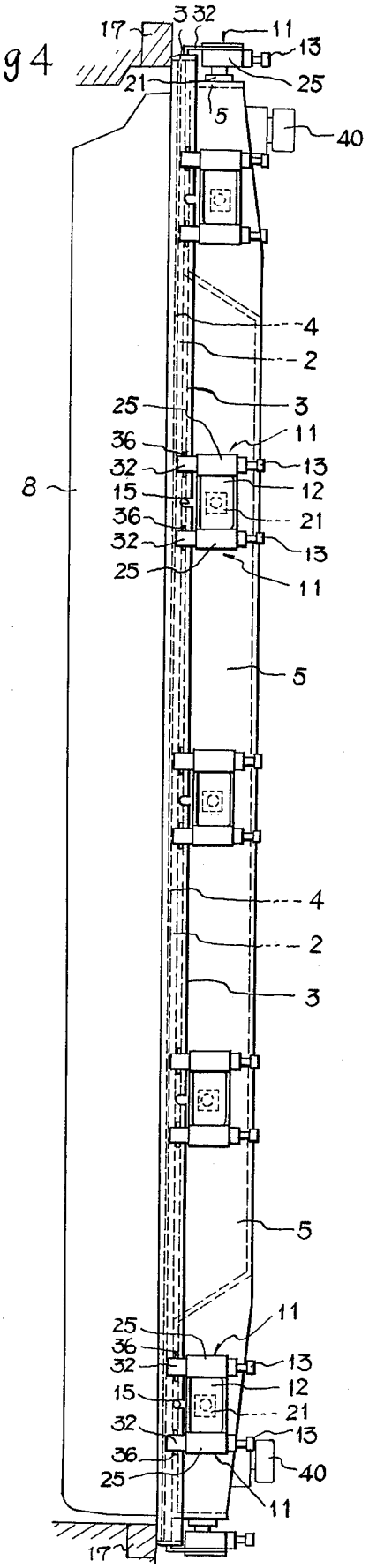
FIG. 4 is a side view of the door of FIG. 3.
Figure 5:
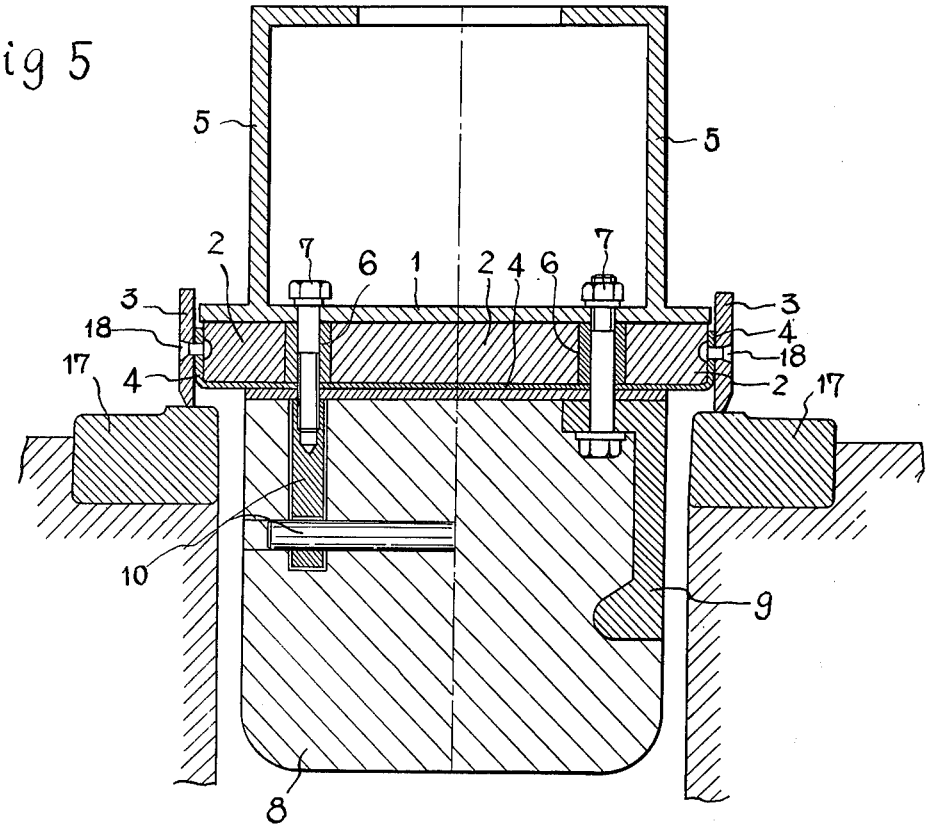
FIG. 5 is a cross-sectional view.
Figure 6:
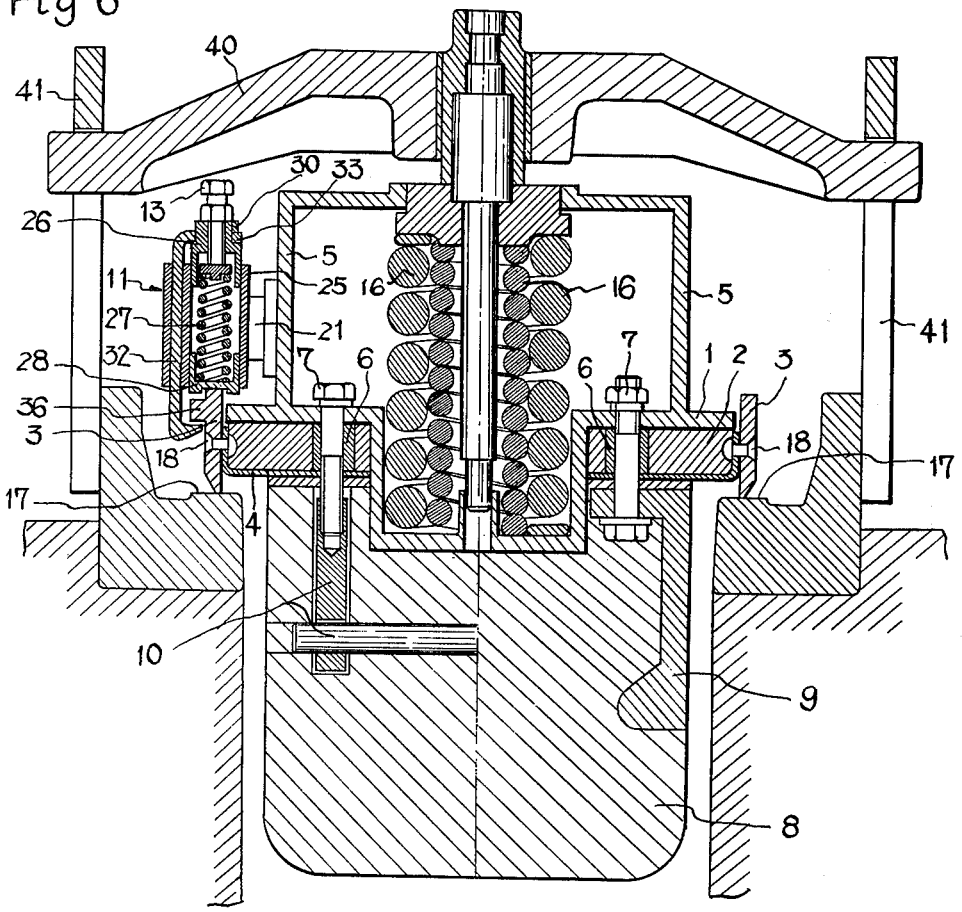
FIG. 6 is a cross-sectional view generally taken at the latch bar portion.
Figure 13:
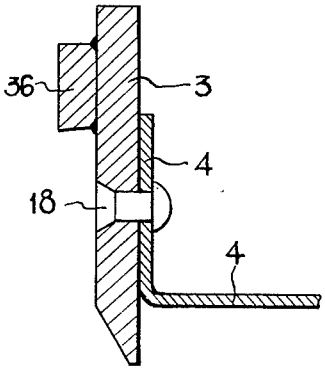
FIG. 13 is a cross-sectional view of the knife edge fixed to the guard plate, said knife edge being fastened by rivets.
Figure 14:
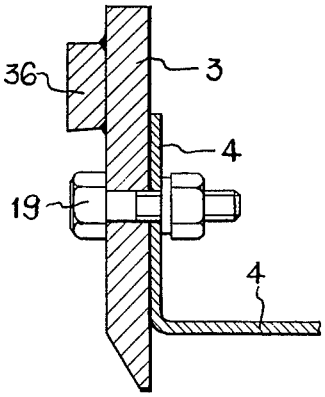
FIG. 14 is the same view as above except that the knife edge is fastened by bolts.

Referring now to the drawings, particularly to FIGS. 1 to 4, there is shown an improved coke oven door in accordance with this invention. The coke oven door includes, like a conventional one, a metallic body with upper and lower latch bars 40, an adiabatic door plug 8 and a frame-like knife edge or seal 3. The inner surface of a base plate 1 of the metallic body is provided with an adiabatic layer 2 show inner surface, in turn, is provided with a guard plate 4. The base plate 1, adiabatic layer 2 and guard plate 4 are fastened by a plurality of distance collars 6 to the adiabatic door plug 8 by bolt or screw 7. In FIGS. 5 and 6, there is shown a screw in the left side and a bolt in the right side. However, these fasteners are not critical features in this invention, so any suitable fastener can be used for fastening the base plate 1, adiabatic layer 2 and guard plate 4 to the adiabatic door plug 8. In the drawings, the reference numerals 9 and 10 indicate a bridge holder and a fitting means, respectively. The periphery portion of the guard plate 4 is bent towards the base plate 1 to form a fitting surface to which the knife edge 3 is fastened with a rivet 18 or a bolt 19.(FIGS. 13 and 14).

Figure 7:
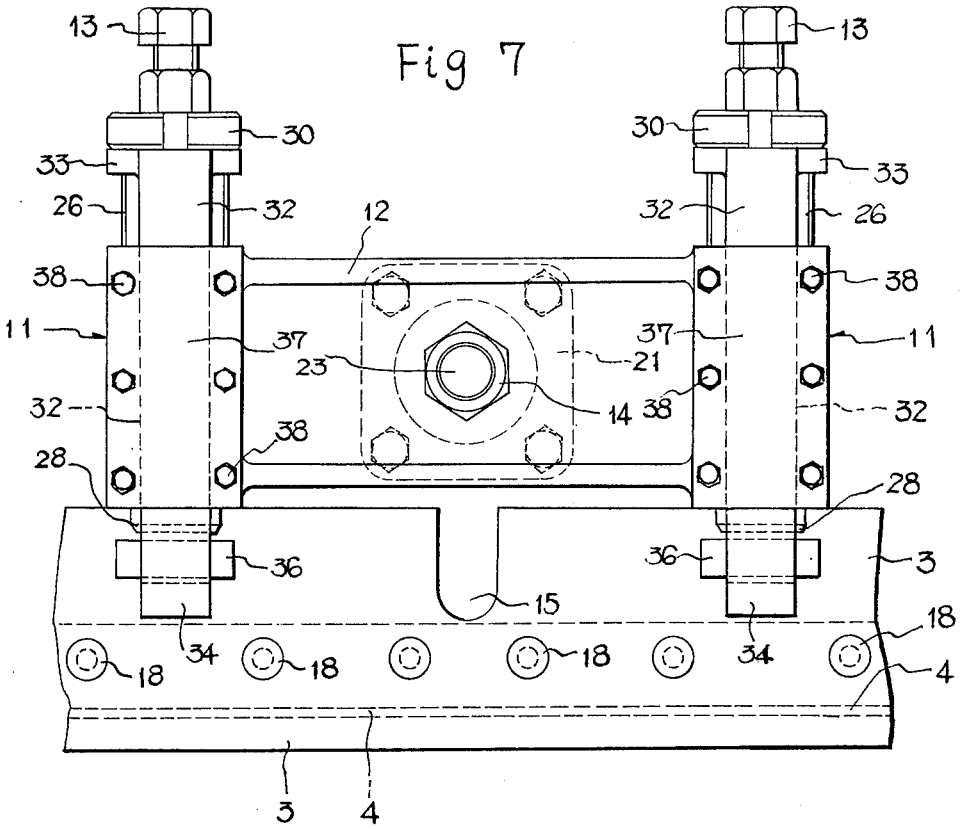
FIG. 7 is an enlarged view showing a holding yoke having end sleeves and a knife edge in FIGS. 2 and 4.
Figure 8:
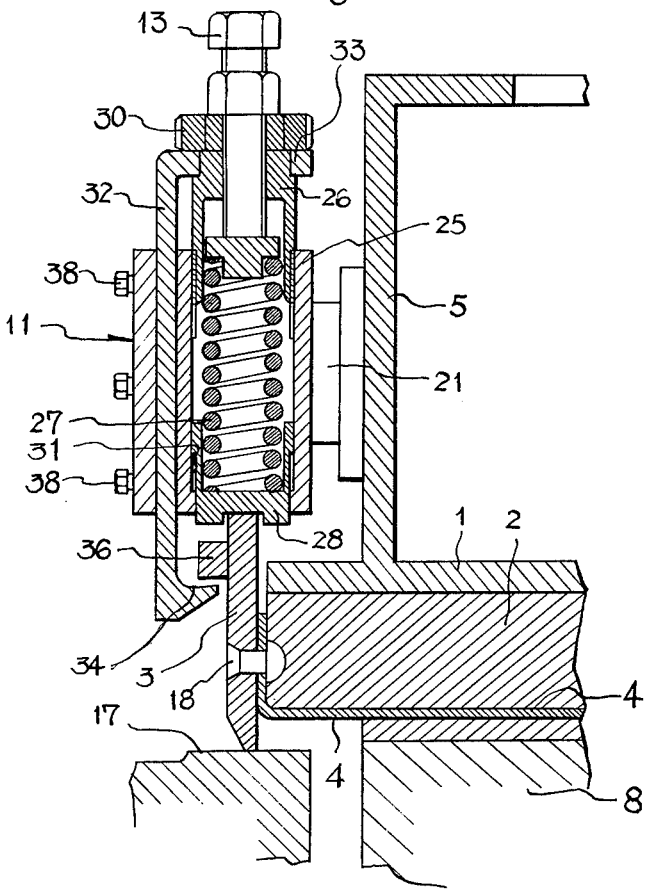
FIG. 8 is a vertical sectional view of the same.
Figure 9:
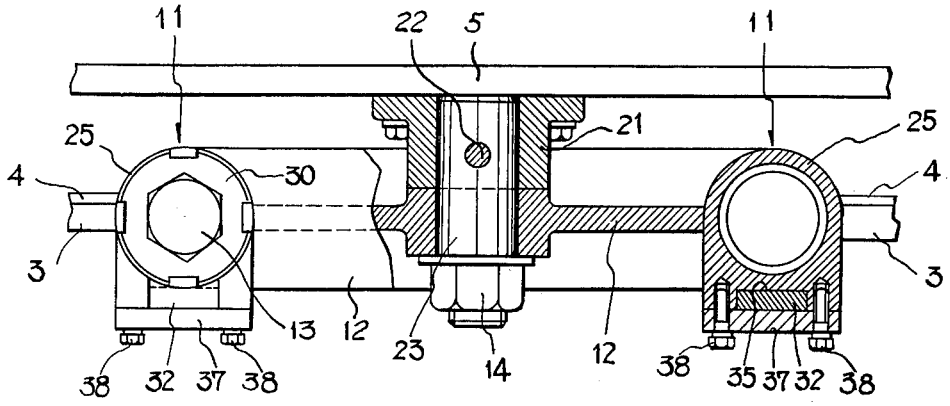
FIG. 9 is a plan view of the same.
Figure 15:
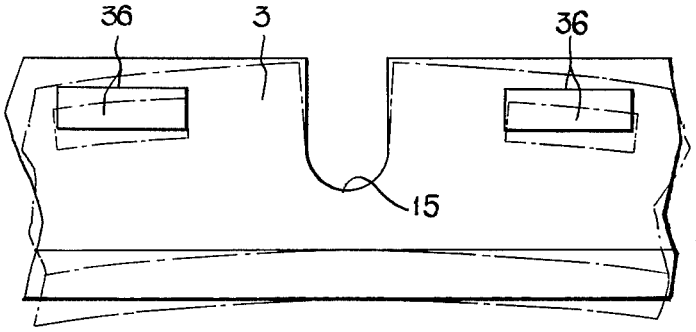
FIG. 15 is an enlarged view of the knife edge showing a somewhat exaggerated example of its flexibility.
Figure 16:
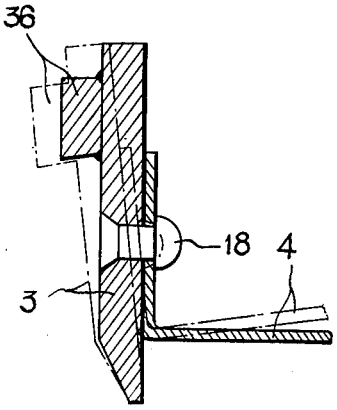
FIG. 16 is an enlarged view of the knife edge showing a somewhat exaggerated example of its twistability.
Figure 10:
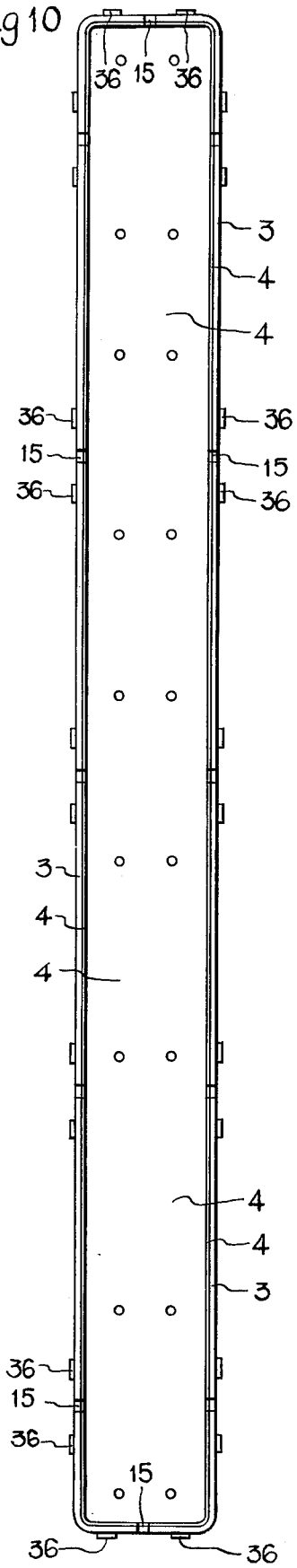
FIG. 10 is a front view of the knife edge fixed to a guard plate.
Figure 11:
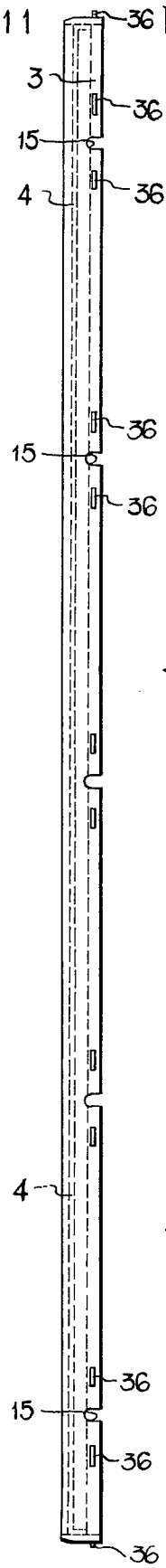
FIG. 11 is a side view of the same.
Figure 12:
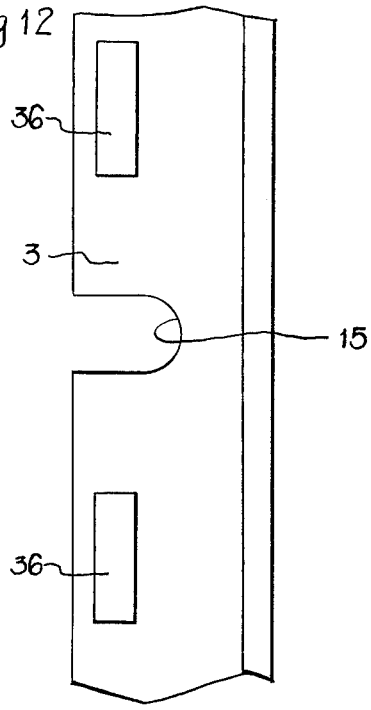
FIG. 12 is an enlarged view of the knife edge shown in part.

The knife edge 3 is formed with plural U-shaped slots 15 opening toward the base plate 1. The U-shaped slots 15 are formed at regular intervals and serve to provide the knife edge 3 with suitable flexibility. As shown in FIGS. 6, 7 and 8, the knife edge 3 is also formed with pairs of projections 36 at each side of the U-shaped slot 15 on its outer surface. The projections 36 serve to retract the knife edge 3 together with the door body.

To such portions on each outer surface of the side walls 5 of the metallic door body, as correspond to the U-shaped slots 15 a plurality of brackets 21 are bolted. A shaft 23 is inserted by half through the bracket 21 and is fastened thereto with a pin 22. On the other half of the shaft 23 is rotatably put a holding yoke 12. The holding yoke 12 is prevented from slipping off the shaft 23 by a nut 14. On both ends of the holding yoke 12, there is provided seal biasing means which includes sleeves 25 wherein a spring unit 11 is inserted. The spring unit 11 comprises an adjusting collar 26 for movably threading a spring pressure adjusting rod 13 therein, a coil spring 27 and a knife edge depressor 28. The adjusting collar 26 is threaded in the sleeve 25 so that when turned through a rotating nut 30 it may be adjusted to lower or elevate in the sleeve 25 thus enabling the knife edge depressor 28 to move accordingly. Reference numeral 31 indicates a margin left for such adjustment. The depressor 28 holds down the knife edge 3 at both sides of the U-shaped slot 15.

There is formed on the outer side of the sleeve 25 a vertical groove 35 wherein a hook lever 32 is inserted. The upper portion of the hook lever 32 is squarely bent inward and the portion thus bent is in the form of a ring 33 which is put on and moved together with the adjusting collar 26. The lower end of the hook lever 32 is bent inward to form a hook 34 which serves to engage with the projections 36. The hook lever 32 is prevented from slipping out the groove 35 by a cover plate 37 which is fastened to the sleeve with bolts 38.

As shown in FIGS. 1 to 4, there is illustrated a pair of latch bars 40, the upper and lower each being equipped on the outer surface of the metallic door body. As apparent from FIG. 6, these latch bars 40 are loaded with a main compression spring 16 and held with latching hook 41.

Figure 17:
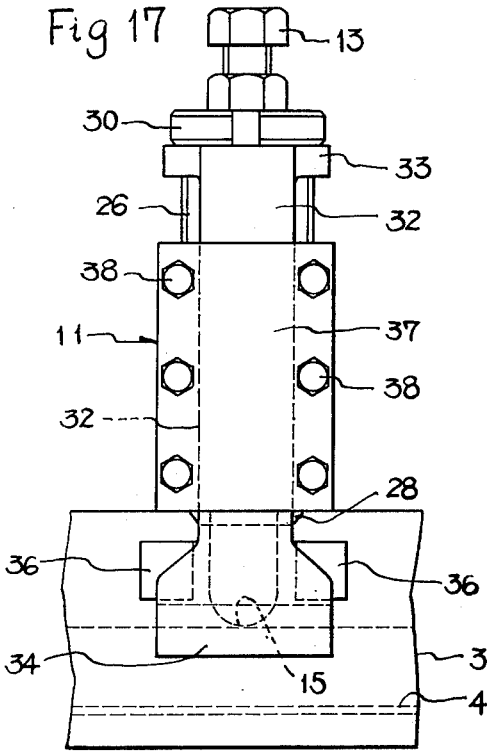
FIG. 17 is a view similar to FIG. 7 but showing different forms of spring units and knife edge.
Figure 19:
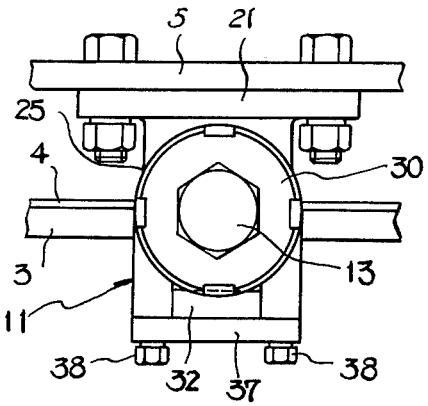
FIG. 19 is a view similar to FIG. 9 but showing different form, or a non-equalizer type spring unit.
Figure 20:
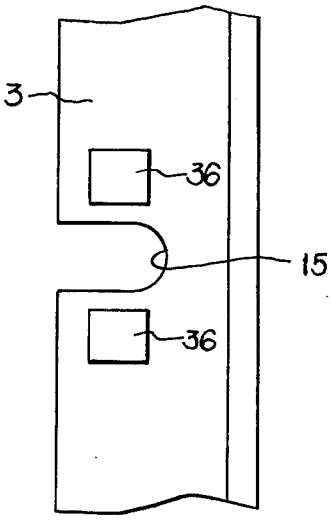
FIG. 20 is a view similar to FIG. 12 but showing a different form of knife edge.
Figure 18:
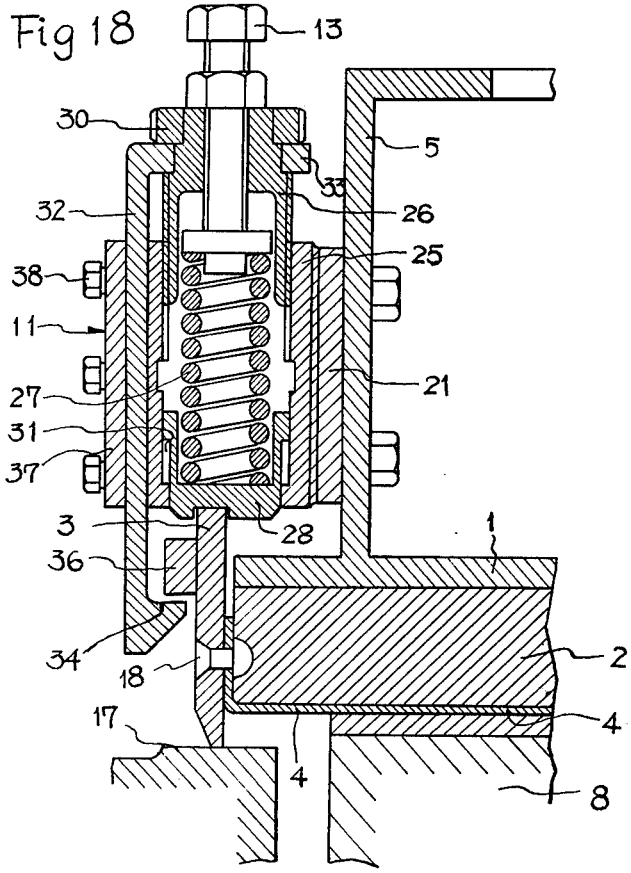
FIG. 18 is a vertically sectional view of the same.

While an equalizer type of pair of sleeves has been so described, there can, naturally, be employed such a single, or non-equalizer, type of sleeves as shown in FIGS. 17 to 19. This type of sleeve 25 is directly fixed on the outer surface of the side wall 5 of the metallic door body. It is to be noted that in this case the depressor 28 and the hook lever 32 are largely broadened at the lower portion so that they can comprehensively take care of the projections 36. For this purpose, the projections 36 are placed relatively near each other.

When the door is fitted on the openings at both sides of the coke oven battery and the latch bars 40 are engaged with the latching hook 41, the knife edge 3 is forced throughout the entire periphery to closely contact the door sealing surface 17 by the pressures of both the main compression springs 16 and the spring units 11. Thiis close contact can be continuously maintained by both the flexibility and twistability around the U-shaped slots 15 of the knife edge 3 and also by self-adjustability of the spring units 11 in the sleeve 25, even when the door sealing frame 17 bend as a result of self-distortion. This guarantees secure prevention of any gas leakage from the knife edge portion. Further, the joint use of the main spring 16 and an equalizer or non-equalizer type spring units 11 can reduce the number of the spring units required to maintain the close contact between the knife edge and the door sealing frame. This enables advantageous operation and maintenance of the door. Further provision of the adiabatic layer 2 between the base plate 1 and the guard plate 4, in addition to the adiabatic door plug 8, remarkably reduces the heat-conductivity of the coke oven door in comparison with any conventional ones. This prevents the base plate 1 from bending outwards and thus serves to provide a door which is subject to as little bending as possible.

Employment of the hook lever 32 guarantees secure prevention of the knife edge from protruding towards the door sealing frame 17 by margin spring pressure. This eliminates eventual damage on both the door sealing frame 17 and the knife edge 3 when the door is removed from the opening of the coke oven.

Although only two preferred embodiments have been shown and described in detail, it should be noted that the present invention is not limited to the specific structure of such embodiments, but embraces such changes and variations as come within the scope of the claims.

What is claimed is:

1. In a self-sealing coke oven door having an inner adiabatic door plug and an outer metallic door body, a latch bar connected to said door body, complementary latching hooks for engaging said latch bar for securing said oven door in the closed position, and a door seal circumscribing the periphery of said oven door, the improvement comprising:

a base plate connected to said metallic door body, a guard plate spaced from said base plate, said guard plate being disposed between said adiabatic door plug and said base plate, an adiabataic layer disposed in the space between said base plate and guard plate, said guard plate shielding the entire inner surface of said adiabatic layer, a sealing means in the form of a knife-like sealing edge circumscribing said guard plate, said knife edge seal being adapted to engage a door frame defining an oven door opening, and said knife edge seal having a series of circumferentially spaced U-shaped slots formed therein opposite said sealing edge, and having projections disposed on the outer surface of said seal on both sides of said slots, and a plurality of means for adjustably biasing said sealing means into sealing position, said biasing means including a seal depressor engaging said edge seal, a spring biasing said depressor, and hook shaped levers adjacent said biasing means for engaging said projections to resist the spring bias acting on said seal means when the door is moved to an opened position.

2. The invention as defined in claim 1 wherein said baising means comprises:

a sleeve disposed to either side of said notches, an adjusting collar disposed in each sleeve, and said depressor being spaced from said collar, said spring being disposed between said collar and said depressor, of each biasing means, said hook lever being disposed adjacent said sleeve, and means for adjusting the bias of said spring means whereby the force exerted by said depressor on said seal means can be varied.

3. The invention as defined in claim 1 wherein said guard plate having laterally bent flanges about the periphery thereof, and means securing said sealing means to said lateral bent flanges.

* * * * *